US006067661A

United States Patent [19]

Bates

[11] Patent Number: 6,067,661

[45] Date of Patent: May 30, 2000

[54] BELT WITH A POUCH

[76] Inventor: Thomas P. Bates, 54 Main St., East Haddam, Conn. 06423

[21] Appl. No.: 09/298,408

[22] Filed: Apr. 23, 1999

[51] Int. Cl.[7] ..... A41F 3/02

[52] U.S. Cl. ..... 2/338; 2/250; 2/312; 2/317; 2/321; 224/587; 225/78

[58] Field of Search ..... 2/338, 247, 253, 2/250, 311, 312, 317, 318, 321, 322; 224/195, 587, 240; 225/78; 600/15, 390; 604/353; 473/502

[56] References Cited

U.S. PATENT DOCUMENTS

| | | | |
|---|---|---|---|
| 2,025,886 | 12/1935 | Nordstrom | 2/338 |
| 2,503,157 | 4/1950 | Knee | 2/338 |
| 3,789,431 | 2/1974 | Rand | 2/236 |
| 4,062,066 | 12/1977 | Weiss | 2/322 |
| 4,399,934 | 8/1983 | Dupont | 224/240 |
| 4,759,483 | 7/1988 | Willoughby | 224/253 |
| 5,129,104 | 7/1992 | Leopoldi et al. | 2/322 |
| 5,299,325 | 4/1994 | Kamber et al. | 2/338 |
| 5,622,301 | 4/1997 | Blum | 224/587 |
| 5,875,523 | 3/1999 | Chen . | |

*Primary Examiner*—John J. Calvert
*Assistant Examiner*—Katherine Moran
*Attorney, Agent, or Firm*—DeLio & Peterson, LLC.

[57] ABSTRACT

A belt comprising an elongated strip of material having a first end and a second end; a pouch at said first end of said strip; an attachment means at said second end of said strip for adjustably connecting said first and second ends of said strip; and a loop for holding said first end of said strip and adapted to allow said pouch to pass through said loop when engaging said attachment means. Preferably, the loop or a portion of the loop comprises an elastic material. Preferably, the attachment means comprises a buckle arrangement.

23 Claims, 2 Drawing Sheets

BELT WITH A POUCH

BACKGROUND OF THE INVENTION

1. Field of the Invention

This invention relates to a belt having a pouch for storing small items wherein the buckle arrangement permits the pouch to be drawn through the buckle arrangement.

2. Description of Related Art

A belt is an important accessory, not only for the person wearing a suit but also for the avid outdoorsman. The belt may contain multiple compartments for storage of small items such as money, pens, knives or other utensils. Many belts which have a pouch tend to be bulky and unsuitable for wearing with a suit. Oftentimes, the pouch is too large to be threaded through belt loops on the pants or skirt and through the buckle of the belt itself. One limiting factor on the belt is the belt loop which holds the free end of the belt. Where the pouch is located at the free end of the belt, the belt loop restricts the passage of the pouch so that the free end having the pouch droops down inconveniently.

Bearing in mind the problems and deficiencies of the prior art, it is therefore an object of the present invention to provide a belt having a belt loop which does not restrict the passage of a pouch attached to the belt.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a belt comprising an elongated strip of material having a first end and a second end; a pouch at said first end of said strip; an attachment means at said second end of said strip for adjustably connecting said first and second ends of said strip; and a loop for holding said first end of said strip and adapted to allow said pouch to pass through said loop when engaging said attachment means. Preferably, the loop or a portion of the loop comprises an elastic material.

The present invention is directed to, in another aspect, a belt comprising an elongated strip of material having a first end and a second end; a buckle unit comprising a frame and a tongue member, said buckle unit attached to a first end of said strip; a pouch at said second end of said strip; and a loop along said strip for supporting said second end of said strip when engaging said buckle unit to adjustably connect said first and second ends of said strip, said loop adapted to accommodate passage of said pouch.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(s)

Figure 1:
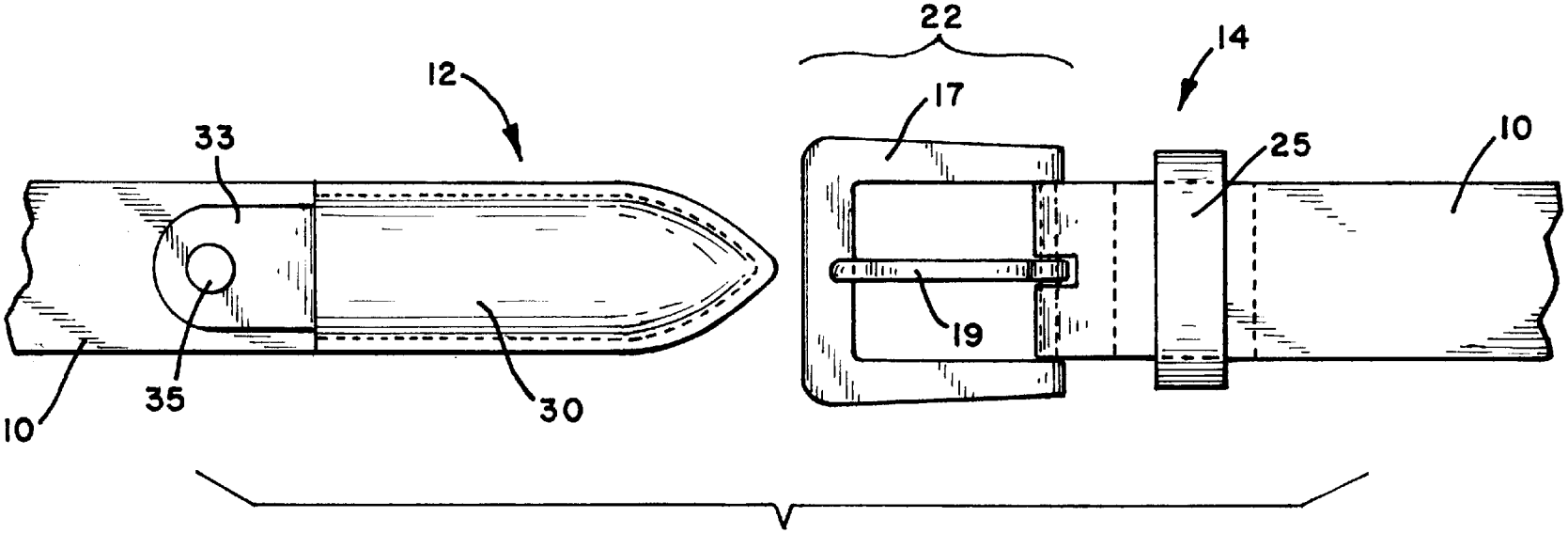
FIG. 1 is a top plan view of a preferred embodiment of the present invention.
Figure 2:
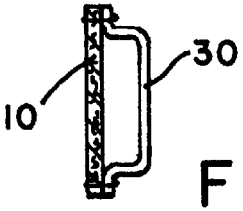
FIG. 2 is a cross-sectional view of the pouch of the present invention.

In describing the preferred embodiment of the present invention, reference will be made herein to FIGS. 1–5 of the drawings in which like numerals refer to like features of the invention. Features of the invention are not necessarily shown to scale in the drawings.

FIG. 1 illustrates a preferred embodiment of the present invention. A strip of material 10 has a first end 12 and a second end 14. The strip of material 10 may comprise leather or other suitable material which, although flexible, does permit the material to hold its shape.

Located at the first end 12 of strip 10 is a pouch 30. Pouch 30 may be formed by stitching a separate piece of material onto the first end 12 as it is shown or may be formed as an integral part of strip 10. Pouch 30 is substantially the width of the strip of material 10 as seen in the cross sectional view of FIG. 2. Although a larger pouch may be contemplated, the pouch of the present invention is of a size that remains discreet yet practical, and is not cumbersome to the wearer. The surface of pouch 30 may be decorated with a design to further enhance its aesthetics. Although the pouch may be located at any location on the belt, it is preferable to locate the pouch at the first end 12 of strip 10 for ease of accessibility.

Figure 3:
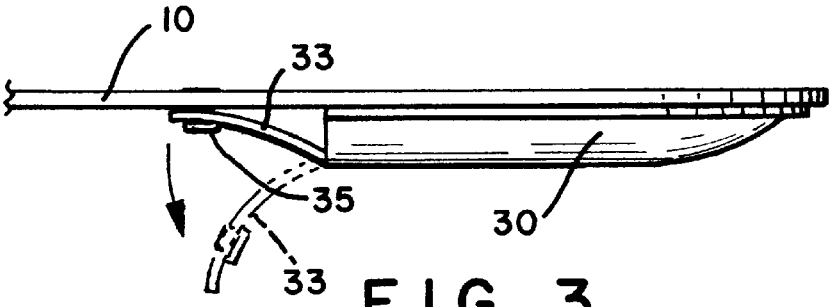
FIG. 3 is a side view of the pouch of the present invention.
Figure 4:
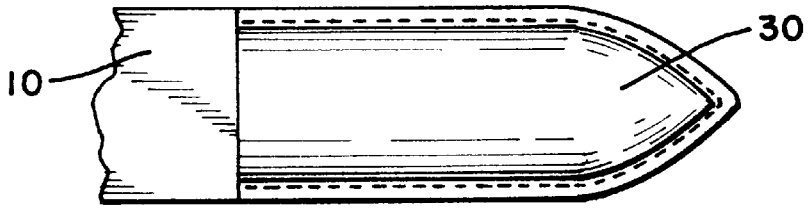
FIG. 4 is a top plan view of another preferred embodiment of the present invention.
Figure 4A:
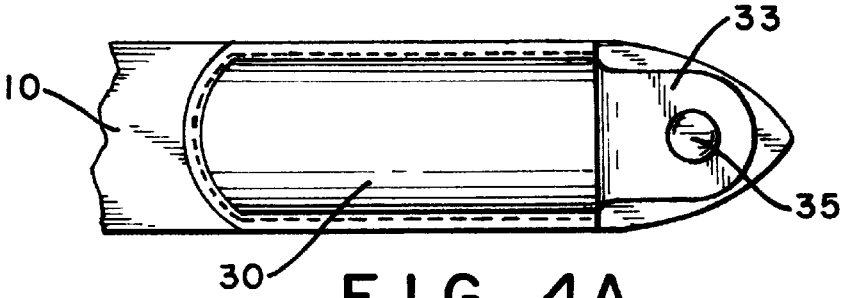

The location of pouch 30 at the first end 12 of strip 10 allows the opening of pouch 30 to be located at a portion of the body of strip 10 as shown in FIGS. 1, 3 and 4 such that a closed end of pouch 30 abuts the edge of the first end 12 of strip 10. Alternatively, the opening of pouch 30 may be directed towards the second end 14 of strip 10 as shown in FIG. 4A such that the opening is adjacent an outer edge of strip 10 at the first end 12 and the closed end is distal from the outer edge of strip 10. Although pouch 30 is shown in FIG. 4A as having a flap 33 with a snap 35 for a closure means, pouch 30 may also be a flapless pouch as in FIG. 4.

In a preferred embodiment, pouch 30 is shown in FIGS. 1 and 3 as having a flap 33 for providing closure of the pouch. Flap 33 may have a closure means such as a snap 35 although other closure means are contemplated. The closable flap 33 provides security for articles tucked within pouch 30. FIG. 4 illustrates a flapless pouch 30 which would be easier for clipping articles such as pens provided the pouch is of sufficient depth.

At the second end 14 of strip 10 is a fastener 22. Different types of fasteners for belts are known in the art and would work well with the present invention as long as they are capable of accommodating the width and thickness of pouch 30. Fastener 22 is preferably a buckle arrangement as shown in FIG. 1.

The buckle arrangement comprises a frame 17 which is preferably attached to the second end 14 of strip 10 by looping the material of strip 10 through frame 17 and perhaps stitching the second end 14 to the body of strip 10. Frame 17 is preferably adapted to be pivotally attached to the second end 14. A tongue member 19 is pivotally attached to an exposed portion of the frame 17 not covered by the loop of material of strip 10. The free end of tongue member 19 rests on frame 17 such that its pivotal motion is limited to a front surface of the belt. The first end 12 of strip 10 would require at least one notch or aperture such that tongue member 19 may be inserted when fastening the belt as shown in FIG. 1.

Adjacent to the fastener 22 is a belt loop 14. In the prior art, belt loops typically do not accommodate the passage of a belt attachment which is wider and thicker than the free end of the belt. In accordance with the present invention, belt loop 25 comprises in whole or in part an elasticized material which accommodates the passage of pouch 30. Typically, belt loops are attached by stitching to the strip of belt material. As an example, where the belt is a leather belt, belt loop 25 may comprise of leather yet have an elasticized portion 50 (shown in FIG. 5) where it is stitched to strip 10. The elasticity of belt loop 14 allows the passage of pouch 30 while capable of laying substantially flat against strip 10 and supporting first end 12 for a neat appearance.

Figure 5:
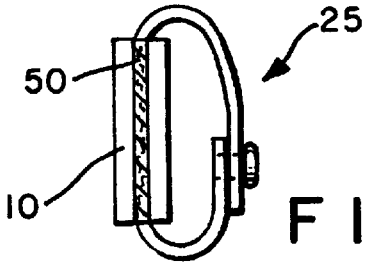
FIG. 5 is a cross-sectional view of the loop of the present invention.

In FIG. 5, an alternative embodiment may be to provide a way of opening and closing belt loop 25 to accommodate pouch 30 while adapted to supporting the first end 12 of the strip 10. Preferably, the closure means comprises a snap although other closure means are contemplated. The portion of belt loop 25 shown as 50 would need not be elasticized in this embodiment.

Thus, in order to wear the belt shown in FIG. 1, an operator would thread the first end 12 of the strip 10 through frame 17, insert tongue member 19 through a notch along strip 10 for a snug fit, and thread the first end 12 through belt loop 25. Belt loop 25 is adapted to reversibly deform to accommodate the passage of pouch 30 and support the first end 12 of strip 10.

The present invention achieves the objects recited above. The belt of the present invention provides a convenient pouch which has a belt loop adapted to accommodating the passage of the pouch yet able to support a free end of the belt without being bulky or slovenly. The whole or partial elasticity of the belt loop allows a pouch preferably located at the free end of the belt to pass through.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A belt comprising:

an elongated strip of material having a first end and a second and;

a pouch at said first end of said strip;

an attachment means at said second end of said strip for adjustably connecting said first and second ends of said strip; and a loop adjacent said attachment means for holding said first end of said strip adapted to allow said pouch to pass through said loop when engaging said attachment means.

2. The belt of claim 1 wherein said pouch has an open end and a closed end, said closed end abutting an edge of said first end of said strip.

3. The belt of claim 1 wherein said pouch has an open end and a closed end, said open end abutting an edge of said first end of said strip.

4. The belt of claim 1 wherein said pouch further includes a closing means.

5. The belt of claim 4 wherein said closing means comprises a flap having a snap.

6. The belt of claim 1 wherein said loop comprises an elastic material.

7. The belt of claim 1 wherein said loop has a portion comprising an elastic material.

8. The belt of claim 1 wherein said loop is adjacent to said attachment means.

9. The belt of claim 1 wherein said loop has an opening.

10. The belt of claim 1 wherein said attachment means comprises a buckle having a frame capable of accommodating said pouch when passing said first end of said strip through said frame, said frame having an attachment member for attaching said strip to said buckle; and a tongue member having a first end and a second end, said first end pivotally attached to said attachment member of said frame and said second end capable of resting on said frame opposite said attachment member.

11. The belt of claim 10 wherein said first end of said strip includes at least one retaining notch on said strip for engaging said tongue member of said buckle.

12. A belt comprising an elongated strip of material having a first end and a second end;

a buckle unit comprising a frame and a tongue member, said buckle unit attached to a first end of said strip;

a pouch at said second end of said strip; and a loop along said strip for supporting said second end of said strip when engaging said buckle unit to adjustably connect said first and second ends of said strip, said loop adapted to accommodate passage of said pouch.

13. The belt of claim 12 wherein said loop comprises an elastic material.

14. The belt of claim 12 wherein said loop has a portion comprising an elastic material.

15. The belt of claim 12 wherein said pouch has an open end and a closed end, said closed end abutting an edge of said first end of said strip.

16. The belt of claim 12 wherein said pouch has an open end and a closed end, said open end abutting an edge of said first end of said strip.

17. The belt of claim 12 wherein said pouch further includes a closing means.

18. The belt of claim 12 wherein said pouch is made from an integral material of said strip.

19. The belt of claim 12 further including at least one retaining notch on said strip adapted to engage said tongue member when passing said first end of said strip through said buckle unit.

20. A belt comprising:

an elongated strip of material having a first end and a second end;

a pouch at said first end of said strip, said pouch having an open end and a closed end, the open end adjacent to an edge of said first end of said strip and the closed end distal from the edge of said first end of said strip;

an attachment means at said second end of said strip for adjustably connecting said first and second ends of said strip; and an expandable loop adjacent said attachment means adapted to allow passage of said pouch through said loop when engaging said attachment means.

21. The belt of claim 20 wherein said pouch further includes a closing means at the open end of said pouch.

22. A belt comprising:

an elongated strip of material having a first end and a second end;

a pouch at said first end of said strip, said pouch having an open end and a closed end, the closed and abutting an edge of said first end of said strip;

an attachment means at said second end of said strip for adjustably connecting said first and second ends of said strip; and an expandable loop adjustment means adapted to allow passage of said pouch through said loop when engaging said attachment means.

23. The belt of claim 22 wherein said pouch further includes a closing means at the open end of said pouch.

* * * * *

UNITED STATES PATENT AND TRADEMARK OFFICE

CERTIFICATE OF CORRECTION

PATENT NO. : 6,067,661

DATED : May 30, 2000

INVENTOR(S) : Thomas P. Bates

It is certified that error appears in the above-identified patent and that said Letters Patent is hereby corrected as shown below:

In claim 22, line 11, delete "and" (second occurrence) and substitute therefor - - end - - .

In claim 22, line 5, delete "adjustment" and substitute therefor - - adjacent said attachment - - .

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*